US005713318A

United States Patent [19]

Tausk et al.

[11] Patent Number: 5,713,318

[45] Date of Patent: Feb. 3, 1998

[54] UNIVERSAL ATTACHMENT EXTENSION TUBE WITH ROTATIONAL LOCKING DEVICE

[75] Inventors: Edward F. Tausk, Downers Grove; Andrew J. DeJacimo, Addison, both of Ill.

[73] Assignee: Navistar International Transportation Corp., Chicago, Ill.

[21] Appl. No.: 740,582

[22] Filed: Oct. 31, 1996

[51] Int. Cl.[6] ..... F01M 9/10

[52] U.S. Cl. ..... 123/90.38; 123/195 C; 123/198 E; 123/DIG. 6

[58] Field of Search ..... 123/90.38, 195 A, 123/195 C, 198 E, DIG. 6, DIG. 7

[56] References Cited

U.S. PATENT DOCUMENTS 4,516,546 5/1985 Choushi et al. ..... 123/195 A
4,608,950 9/1986 Payne et al. ..... 123/195 C
5,095,860 3/1992 Newell ..... 123/195 C
5,375,569 12/1994 Santella ..... 123/90.38

*Primary Examiner*—Weilun Lo
*Attorney, Agent, or Firm*—Dennis K. Sullivan

[57] ABSTRACT

An extension tube for an internal combustion engine oil fill tube comprises an elongate bent cylindrical member having one threaded end adapted to engage within a threaded port in a valve cover. The tube includes a protruding nub thereon which is positioned to coact with a cavity between segmented threads in the port to produce a detent between the tube and the port when the tube is threaded into the port to a desired relative rotational orientation, for maintaining such orientation. The tube further includes a peripheral flange which compresses a high swell material seal member placed therebeneath against an area disposed about the port to ensure integrity of the engagement.

16 Claims, 3 Drawing Sheets

PRIOR
ART

UNIVERSAL ATTACHMENT EXTENSION TUBE WITH ROTATIONAL LOCKING DEVICE

BACKGROUND OF THE INVENTION

The present invention relates to internal combustion engines and more particularly, to an extension tube which can be locked in place quickly within a threaded port, such as an oil fill port on a valve cover of an engine, during assembly of the engine. Extension tubes are used in certain vehicles, such as vans, to position the oil fill opening for adding oil to the engine in a convenient location to prevent spilling oil. The extension tube of the invention takes on a desired fixed rotational orientation when locked in place. Further, the universal attachment formed between the tube and the port may be utilized in contexts other than producing an oriented oil fill port extension, such as crankcase ventilation or dipstick tubes, or with other engine covers, such as valley pans or oil pans.

THE PRIOR ART

Heretofore, problems have occurred with respect to mounting an oil fill extension tube to an engine valve cover. Tubes that are welded or brazed in place are not satisfactory because the assembled valve covers cannot be stacked for factory inventory. Further, brazing or welding may produce distortion in or damage the valve cover. However, the extension tube must be secured in fixed position so that the torque applied during removal of the oil fill cap from the tube will not cause the extension tube to become loosened or disengaged from the valve cover. Further, it is desirable, that the port in the valve cover also accommodate a standard fill cap since not all vehicles employing a particular engine model will require an extension tube.

Presently available extension tubes take many forms. In one three-piece embodiment shown in FIG. 1, a short screw-in cylinder, referred to as a nipple, is rotationally engaged within the port. One end of an elongate curved tube is connected to the free end of the nipple by a rubber sleeve and holding the assembly together with clamps. The free end of the curved tube is capable of being threadedly engaged by an oil fill cap thereon. This embodiment cannot be positively locked in place and vibrate loose or be loosened when the cap is unthreaded from the free end of the extension tube. Other extension tube designs can be seen in U.S. Patent Nos. 4,516,546 and 4,608,950.

SUMMARY OF THE INVENTION

Accordingly, it is a primary object of the invention described and claimed herein to provide a extension tube which can be positive locked in place easily in an engine port, during assembly of the engine to provide a fluid tight, vibration resistant joint.

It is a further object of the invention to provide an extension tube capable of providing a physically-indicated, fixed rotational orientation relative to the engine port for use when the extension tube is curved.

Yet a further object of the invention is to provide a detent in the interface between the extension tube and the engine port to assure that the desired rotational orientation of the tube remains fixed despite loosening torque applied to the tube when the tube end cap is removed.

These and other objects are specifically met in an oil fill extension tube with rotational locking device of the present invention which comprises an elongate tube, a first end of which is rotationally engageable within an oil fill port of the segmented thread type of an engine valve cover, the tube being locked into a fixed, rotationally-oriented position within the port by a detent, formed on the tube which engages a cavity between the thread segments disposed in the port to provide a desired orientation of the tube. A radial flange on the periphery of the extension tube compresses a high swell seal ring to provide a fluid tight seal against the upper surface of the valve cover. Additionally, this enhances the locking capability of the detent as the seal ring swells. A second free end of the extension tube is adapted to be threadedly engaged by an oil fill cap.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
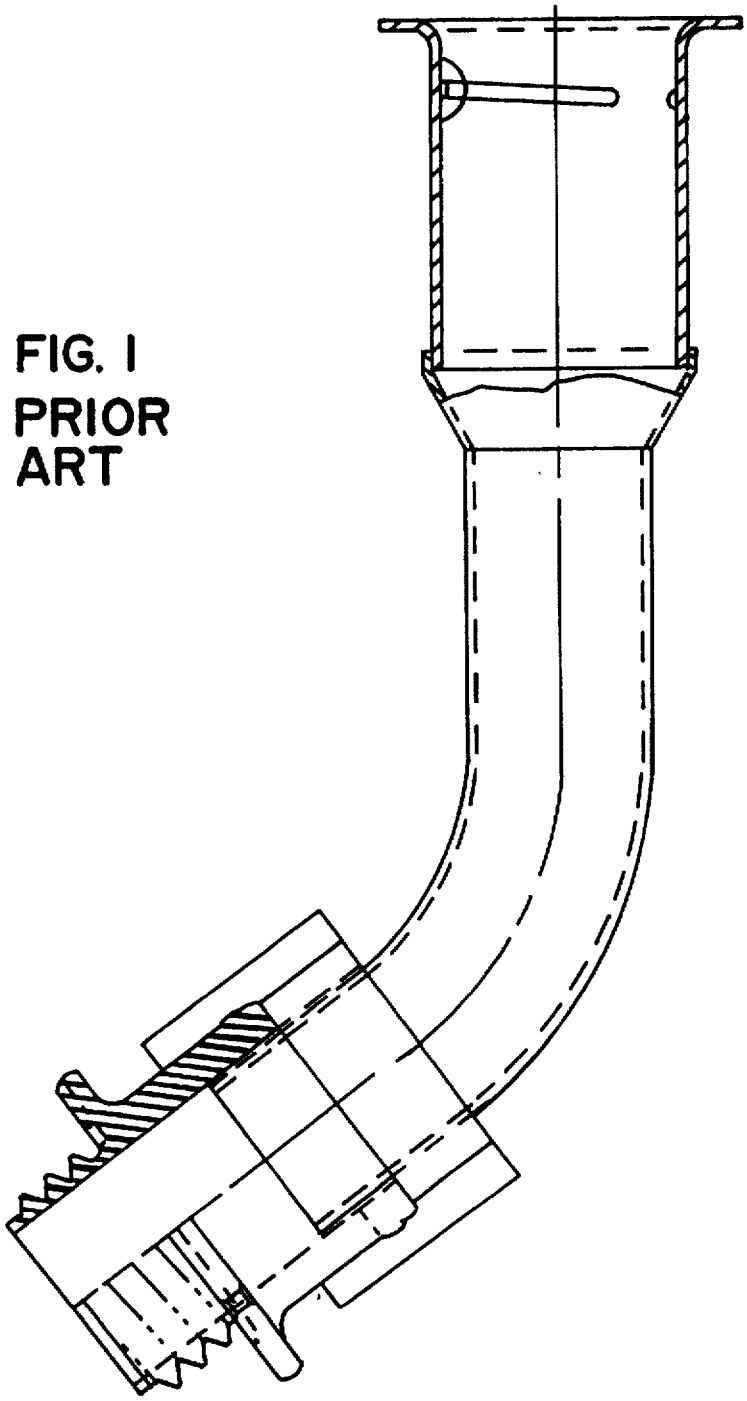
FIG. 1 is a side perspective view partly in section of a prior art multipiece oil fill extension tube.

Referring now to the drawings in greater detail, there is illustrated in FIG. 1 a prior art multipiece oil fill extension tube assembly a disposed in the valve cover of an internal combustion engine. comprising a nipple having one threaded end for connecting to the valve cover port. Attached to the free end of the nipple by a rubber sleeve is one end of a curved extension tube having a second threaded end adapted to receive a fill cap. The fill cap would also fit in the valve cover port. However, there is no provision for positively locking the extension tube assembly into a predefined rotationally oriented position relative to the valve cover for ease in pouring oil into and through the tube. Further, vibration can cause the assembly to rotate and loosen. Still further, when the fill cap is removed from the assembly, rotation of the cap may also loosen the frictional engagement between the nipple and the port, or between the rubber sleeve and either the nipple or the tube.

Figure 2:
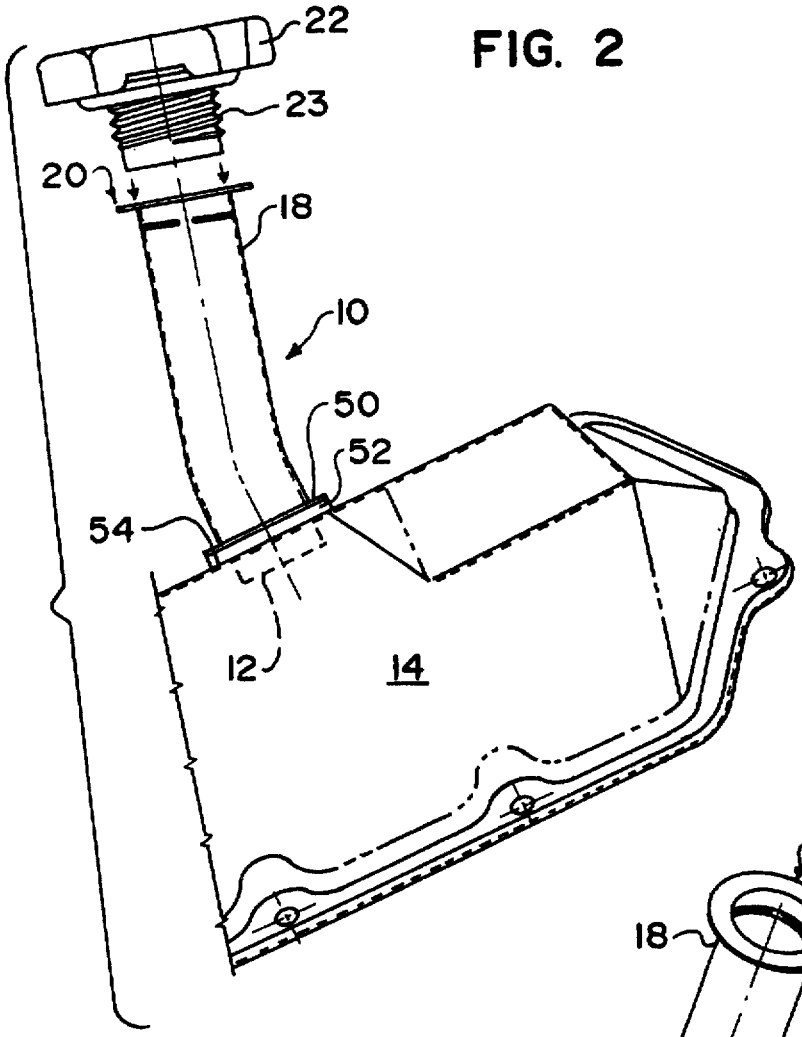
FIG. 2 is a side view of a portion of an engine valve cover showing the extension tube of the present invention engaged to an oil fill port of the valve cover.
Figure 3:
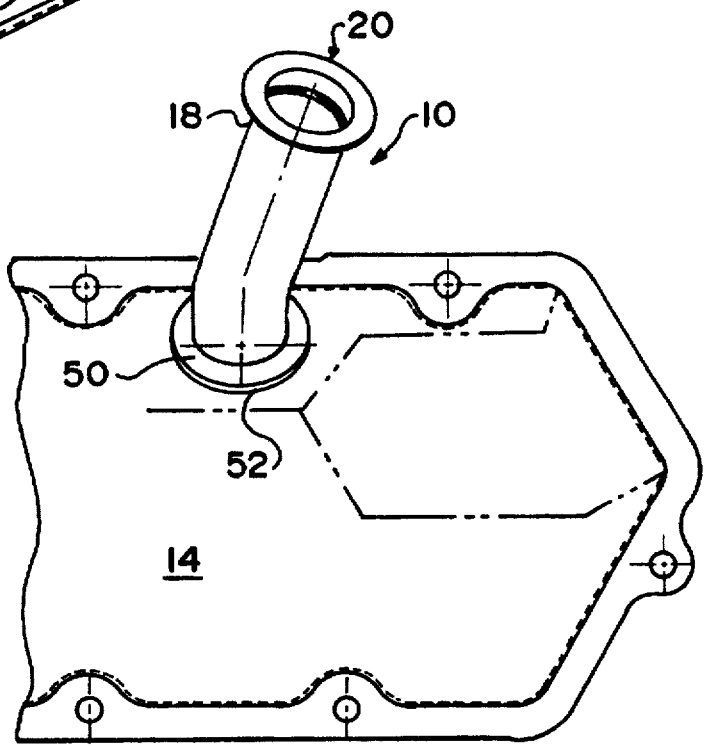
FIG. 3 is a top view of the engine valve cover of FIG. 2 and shows one rotational orientation of the extension tube relative to the valve cover.

Turning now to FIGS. 2–3, there is illustrated therein the extension tube with locking device made in accordance with the teachings of the present invention and generally identified by the reference numeral 10.

As shown, the extension tube 10 is a unitary member 10 which is rotationally securable within a threaded port 12 of an engine housing such as a valve cover 14. Although this disclosure is directed by way of example to an oil fill extension tube 10, this is not to be construed as limiting to the scope of the invention. As stated above, a similar extension tube mounting may also be used for crankcase ventilation fitting, for a dipstick tube, and may attach tubes to other engine structures, such as a valley pans or oil pans.

The extension tube 10 is an elongate cylindrical member having a first, reduced diameter externally threaded end 16 adapted to threadedly engage within the threaded port 12. A second end 18 of the tube 10 may also be internally threaded to provide a seat 20 for a typical threaded fill cap 22. The dimensions of the threaded end 16 of the extension tube 10 mimics the dimensions of the threaded portion 23 of the cap 22, providing a substantially universal accommodation of various fill tube arrangements for various vehicle chassis configurations. In this respect, where an existing fill port 12 in the valve cover 14 is positioned to easily accommodate filling, the cap 22 is merely secured within the port 12. The tube 10, on the other hand, is provided to accommodate chassis configurations where direct filling through the port 12 is less convenient or impossible.

The extension tube 10 is bent or curved at a chosen point toward the first or port engaging end 16 thereof to provide a specific rotational orientation for the tube 10 to properly position the fill end 18 of the tube 10 relative to the vehicle (not shown).

For this reason, the extension tube 10 positively locks into the desired rotational orientation relative to the threaded port 12. Such locking capability prevents vibration from affecting the integrity of the engagement, as well as preventing the tube from being removed or loosened when the cap 22 is rotated for removal from the tube 10.

Figure 4:
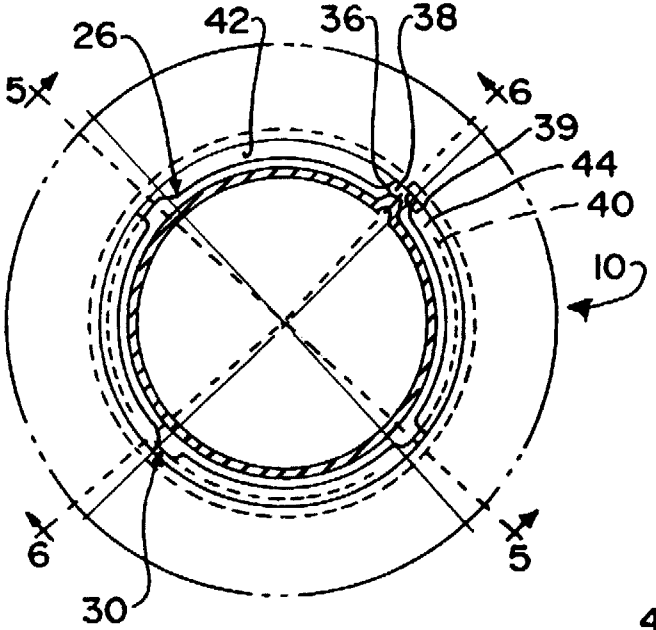
FIG. 4 is an axial view partly in section of the engagement between the extension tube and the valve cover port, showing the coaction between the elements of a detent for locking the tube in a desired rotational orientation.
Figure 5:
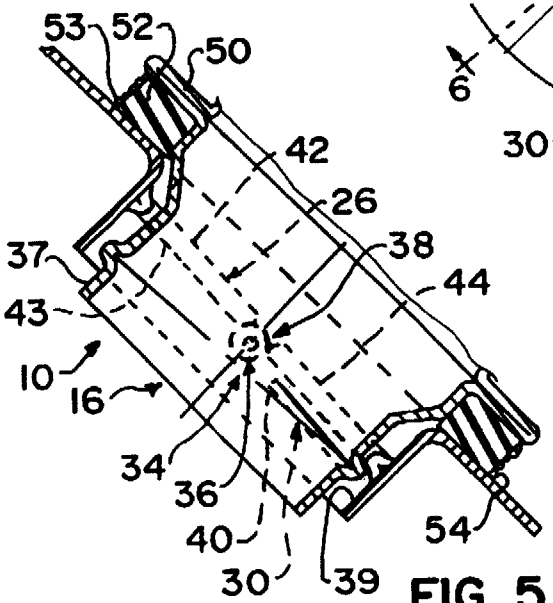
FIG. 5 is a cross-section through the area of engagement taken along line 5—5 of FIG. 4.
Figure 6:
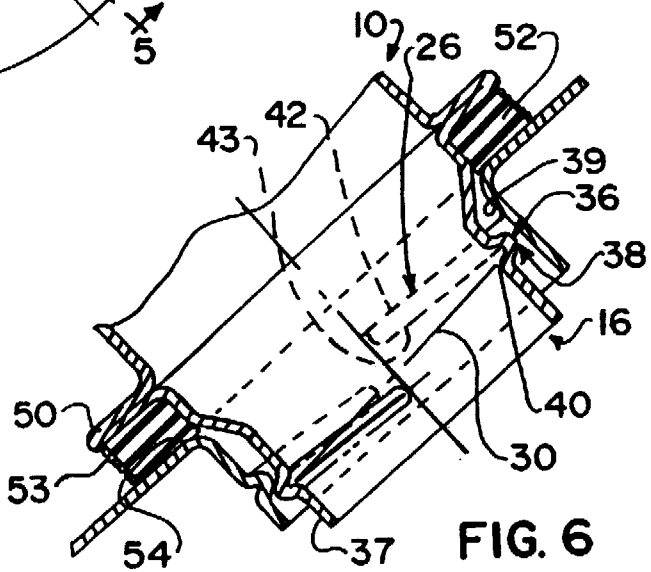
FIG. 6 is a cross-section through the area of engagement taken along line 6—6 of FIG. 4.

As shown in FIGS. 4–6, it will be seen that the port 12 is provided with an internal female thread 26 having four thread segments as is common in engine parts which are cast or formed of sheet metal. The tube 10, on the other hand, is provided with a male thread 30, which coacts with the female thread 26 of the port 12, in a known manner.

The tube 10, as described above, is locked within the port 12 at the desired rotational orientation thereof relative to the valve cover by a cooperative detent means 34. In the disclosed embodiment, the detent 34 is formed by a first locking element or protruding nub 36 which is located at a predetermined position on an outer circumference 37 of the tube 10, interacting with a second cooperating element 38, such as a depression, space or cavity 38, fixed in position on an inner circumference 39 of the port 12. Because the female thread 26 in this embodiment is segmented, the nub 36 interacts with the cavity or space 38 between adjacent thread segments 42 of the female thread 26 of the port 12. The protruding nub 36 is located adjacent to and slightly above an upper or trailing end 40 of the male thread 30 of the tube 10 to assure full enlargement of the male threads in the port 12.

In use, as the male thread 30 of the tube 10 is threaded into engagement with the female thread 26 of the port 12, the nub 36 engages against a first segment 42 of the segmented female thread 26 of the port 12. By the application of an increased rotational force, the nub 36 is forced under the segment 42, riding along a thread engaging surface 43 of the segment 42, until it reaches the space or cavity 38 between the first thread segment 42 and an adjacent thread segment 44. Upon reaching the space 38, the nub 36 snaps upwardly into the space 38, by virtue of its offset position relative to the tube thread 30 as described above, and becomes trapped within the space or cavity 38, positively locking the extension tube 10 in position against further rotation in either direction, with such locking providing a physical indication of desired engagement and orientation.

It will be understood that a simple variance in positioning of the nub 36 about the circumference 37 of the extension tube 10, relative to a predefined fixed position of a cooperating element such as cavity 38 on the inner circumference 39 of the port 12, will accommodate virtually any desired rotational orientation for the extension tube 10, the achieved orientation being physically indicated, and becoming easily duplicable.

It will be seen that the extension tube 10 also includes a radially outwardly flared peripheral flange 50 which is positioned a predetermined distance above the detent 36. Such flange 50 functions first to compress a high swell polymeric seal ring 52 placed about the tube end 16 against a circular top edge surface 54 of the valve cover 14 disposed about the port 12. A preferred material of the seal ring 52 is 70 durometer, EPDM elastomer. Preferably, the outer peripheral edge of the seal ring 52 further includes a molded-in, circumferentially-extending fabric band 53 to prevent the seal ring 52 from extruding out from under the flange 50 especially when it swells. When the high swell seal ring 52 is exposed to engine oil, it expands. Such expansion assures the fluid tight integrity of the seal between the extension tube and the valve cover.

The compression of the seal ring 52 by the flange 50 during initial installation of the extension tube 10 in the valve cover pulls the nub 36 up into the cavity 38, thereby increasing the torque required to cause disengagement of the detent 34 and locking the extension tube against rotation. Then, as the engine is operated, the expansion of the high swell seal ring 52 further increases the effectiveness of the locking device.

It will be understood that the detent means 34 could also be formed utilizing a cavity 38 between thread segments other than that between the first and second segments of a segmented thread. Such variation would obviously require elevating the flange 50 to a specific height to accommodate a further degree of downward rotation of the tube 10 into the port 12 to allow for formation of the detent means 34 between any desired adjacent thread segments.

The above defined configuration of the detent means 34 has been found to be a simple, functional embodiment for use in a situation where the port thread 26 is segmented. However, the detent means 34 could also be created by providing a space or cavity 38 at a predetermined position along a non-segmented thread to provide a desired relative rotation for the tube 10 as well. Still further, it would be feasible to create a depression or cavity 38 along the circumference 39 of the port 12 and to provide a hub 36 at a position on the circumference 37 of the tube 10 which would produce a detent means 34 by engaging within the depression 38 when the extension tube 10 was aligned in a proper relative rotational orientation.

As described above, the extension tube 10 of the present invention provides a number of advantages, some of which have been described above and others of which are inherent in the invention. Also, modifications may be proposed to the tube 10 without departing from the teachings herein. Accordingly, the scope of the invention should only be limited as necessitated by the accompanying claims.

What is claimed is:

1. In combination with an internal combustion engine cover having a threaded port, an extension tube comprising a tubular structure having a first threaded end engaged within said threaded port, the extension tube including cooperative detent means thereon which cooperate with said threaded port to create a detent between the tube and the port when the tube is threadedly engaged at a desired relative rotational orientation, for maintaining such orientation.

2. The invention of claim 1 wherein the cooperative detent means comprises a protruding nub on the extension tube which engages within a cooperating cavity in the port.

3. The invention of claim 2 further including a peripheral flange which is a predetermined distance above the nub.

4. The invention of claim 3 wherein a circumferential seal is positioned about the tube between the nub and the flange.

5. The invention of claim 4 wherein the seal is compressed against a peripheral edge of the port by the flange when the detent is engaged.

6. The invention of claim 4 wherein said seal is made of high swell material.

7. The tube of claim 3 further having a second threaded end for engaging a threaded cap.

8. The tube of claim 7 wherein dimensions of the second threaded end approximate dimensions of the port.

9. The tube of claim 8 wherein the tube has an arcuate portion disposed between the flange and the second threaded end thereof.

10. In combination with an internal combustion engine valve cover having threaded oil fill port, an oil fill extension tube which can be positively locked into said threaded fill port at a desired relative rotational orientation relative to the valve cover, the fill tube comprising an elongate cylinder having a first threaded end rotationally engageable within the threaded port and including a protruding nub thereon which is positioned to engage a cooperating depression located at a predetermined position in the port when the desired rotational orientation is achieved.

11. The invention of claim 10 further including a peripheral flange disposed at a predetermined distance above the nub.

12. The invention of claim 11 wherein a circumferential seal is positioned about the tube between the hub and the flange.

13. The invention of claim 12 wherein the seal is compressed against a peripheral edge of the port by the flange when the detent is engaged, said seal comprising a high swell material.

14. The invention of claim 11 further having a second threaded end for engaging a threaded cap.

15. The invention of claim 14 wherein said threaded cap may be installed in both the second threaded end and in the threaded port in the valve cover.

16. The invention of claim 11 wherein the tube has an arcuate portion disposed at a preselected point between the flange and the second threaded end thereof.

* * * * *